United States Patent [19]

Trimpey

[11] 4,171,769

[45] Oct. 23, 1979

[54] TEMPERATURE ANTICIPATOR AND NIGHT LIGHT APPARATUS

[76] Inventor: Philip N. Trimpey, 106 N. Sycamore Dr., Karthaus, Pa. 16845

[21] Appl. No.: 795,014

[22] Filed: May 9, 1977

[51] Int. Cl.[2] ..... H01H 37/14; F23N 5/20

[52] U.S. Cl. ..... 236/46 R; 236/68 B; 337/277

[58] Field of Search ..... 236/46 R, 68 B; 62/202; 337/377, 303; 219/511, 506, 374; 165/12

[56] References Cited

U.S. PATENT DOCUMENTS

| | | | |
|---|---|---|---|
| 1,394,667 | 10/1921 | Corbin, Jr. | 219/220 |
| 3,147,369 | 9/1964 | Salton | 210/358 UX |
| 3,834,618 | 9/1974 | Buckwalter | 236/46 R |
| 3,849,753 | 11/1974 | Nichols | 337/377 X |
| 4,014,500 | 3/1977 | Galtz | 236/68 B |
| 4,119,936 | 10/1978 | Lviana et al. | 236/46 R |

*Primary Examiner*—William E. Wayner
*Attorney, Agent, or Firm*—Leonard W. Suroff

[57] ABSTRACT

A temperature anticipator and night light apparatus which may be conveniently utilized with existing heating systems by mounting the apparatus within an airflow influencing distance from a conventional thermostat which controls the heating system. When operating, the apparatus provides a convection flow of heated air during prescribed time intervals in order to cause the thermostat to turn off the heating system prior to reaching the setting thereon.

10 Claims, 4 Drawing Figures

TEMPERATURE ANTICIPATOR AND NIGHT LIGHT APPARATUS

BACKGROUND OF THE INVENTION

This invention relates to apparatuses for automatically setting back or anticipating the temperature of a room controlled by a conventional heating system theremostat during preselected time periods, and in particular, relates to a combination temperature anticipator and night light apparatus which, by adjusting the proximity to the conventional thermostat, is capable of modifying the number of setback degrees desired.

The art abounds with numerous devices for modifying the temperature setting of a thermostat which is used to control the heating in a home or a place of business. In the face of the current energy crisis, it is extremely desirable to reduce the amount of heating supplied during nighttime hours when, either the occupants of the building are no longer there as in a business establishment, or during the sleeping hours in a home when persons are not moving about and are protected by various types of blankets. Generally, each of the apparatuses known in the prior art are expensive, require difficult installations, or special thermostats and controls to accomplish a temperature decrease during selected periods of time. Typical examples of setback controls known in the prior art may be found in U. S. Patents as follows:

| Patent No. | Issue Date | Inventor |
|---|---|---|
| 3,352,490 | November 14, 1967 | Dalzell et al |
| 3,834,618 | September 10, 1974 | Buck Walter |
| 3,849,753 | November 19, 1974 | Nichols |
| 3,934,217 | January 20, 1976 | Brcic |
| 3,945,564 | March 23, 1976 | Smallegan |
| 3,983,928 | October 5, 1976 | Barnes |

The thermostats in use with conventional heating systems, whether for use in the home or factory, generally have a lower level in the range of 50 to 60 degrees Farenheit. However, when a factory or office building is closed for the evening and no work is being done, it is not economical and a serious waste of energy to maintain the temperature at 50 or 60 degrees when the outside temperature drops below the freezing point.

At this time, it would be extremely desirable to be able to maintain the building temperature above the freezing level to prevent water pipes and other vulnerable devices from becoming damaged. Thus, it would be most advantageous to be able to maintain the temperature at a level, for example, of 35 to 40 degrees Farenheit. Obviously, this can be accomplished by completely turning off the heating system during the evening hours, However, the possibility exists that the inside temperature may drop below the freezing point, which of course is undesirable.

The other alternative is to utilize a temperature anticipator or setback control device which is energized by a time control apparatus enabling the thermostat to read an air-flow temperature which is higher than that actually occurring in the room. This is especially advantageous over long shut-down periods such as a weekend for a factory or business, or vacation time when no one is left at home.

SUMMARY OF THE INVENTION

The present invention is directed to a device which provides both light and heat and is particularly suited for easy installation proximate the conventional thermostat used to control a heating system. Present apparatus is controlled by a timing device which energizes a light and heat source during preselected evening hours and by bypassing the timer may be maintained in an energized condition continuously.

In combination, a temperature anticipator and night light apparatus for use with thermostatically controlled heating systems includes an elongated mounting means disposed vertically proximate the thermostat and therebeneath, the mounting means having indicia thereon along its longitudinal axis; an incandescent light assembly which includes an incandescent lamp slidably affixed to the mounting means for providing a source of heat and light when energized. A director circumscribes the lamp and directs the heat from the lamp towards the thermostat. A timer is coupled to a source of electrical energy and couples the electrical energy to the light means at prescribed intervals.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
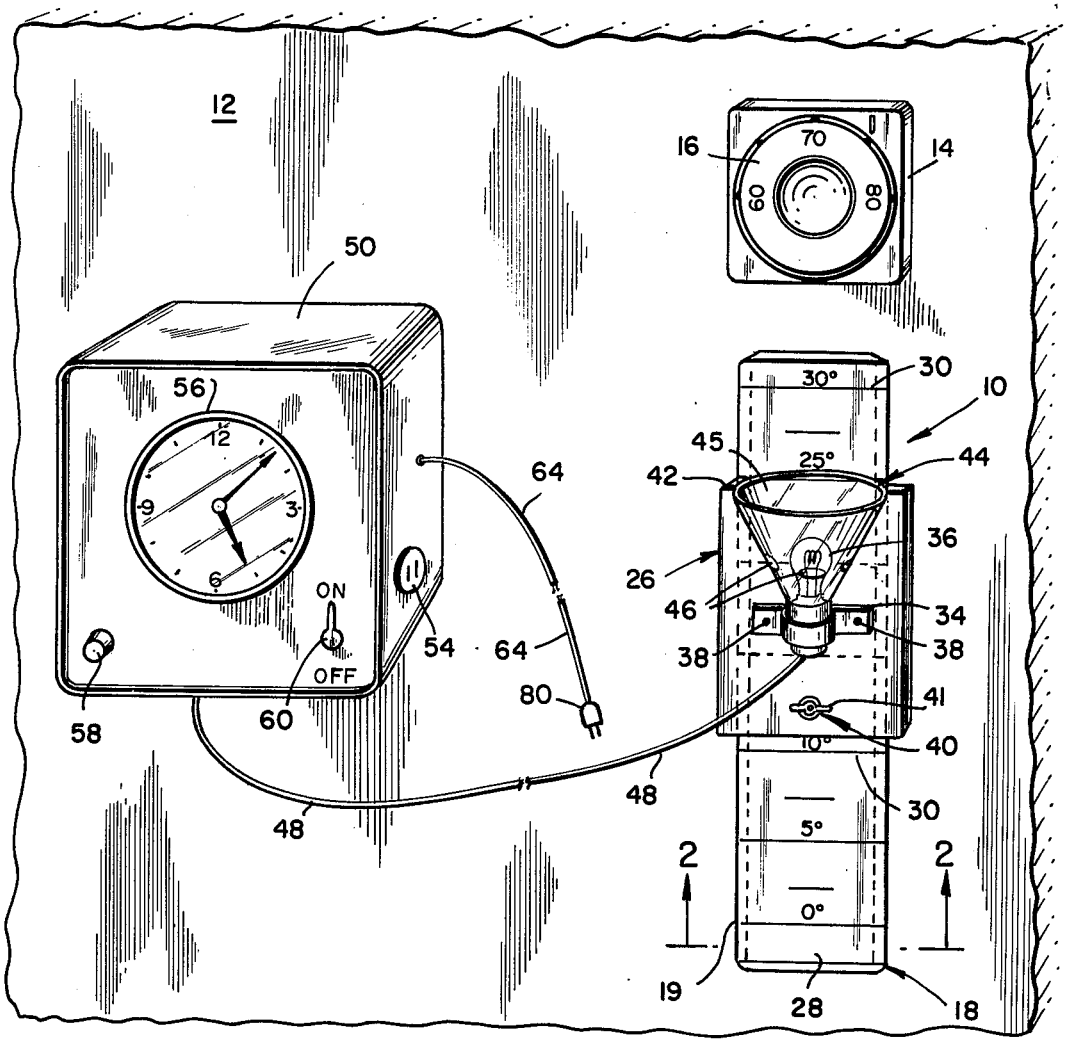
FIG. 1 is a pictorial representation of a combination temperature anticipator and night light according to the principles of the present invention.
Figure 2:
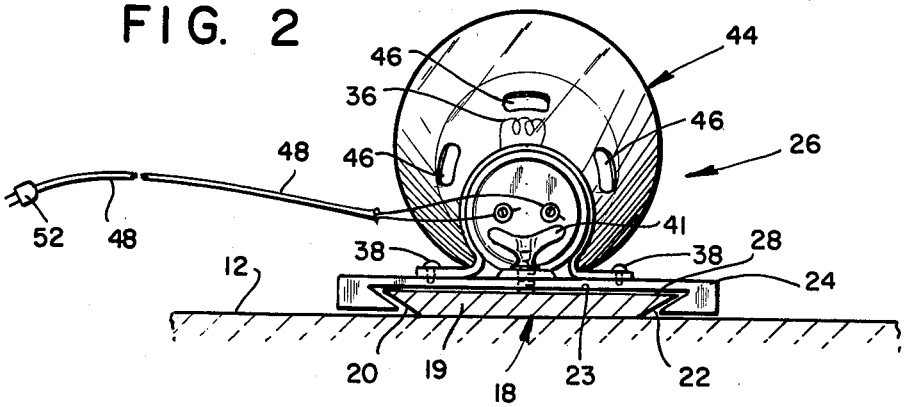
FIG. 2 is an enlarged view, partially in section, taken along the lines 2—2 of FIG. 1.

Referring now to the drawings, and in particular to FIGS. 1 and 2, there is shown a combination temperature anticipator and night light apparatus 10 mounted on a wall 12 proximate a conventional thermostat 14. The thermostat 14 includes a temperature control dial 16 and is connected to a heating system, not shown, which is conventional.

As illustrated in FIG. 1, the thermostat 14 provides for maintaining an ambient air temperature of between 60 degrees Farenheit and 90 degrees Farenheit, which is a typical temperature range of a thermostat used to control the heating system of a single-family residence, apartment, or office unit.

The apparatus 10 includes an elongated mounting means 18 disposed vertically or in an upwardly direction proximate the thermostat 14 and is positioned in line and below it. The mounting means 18 includes a mounting plate 19, that may be affixed to the wall by using double-sided adhesive tape, screws, or any other conventional means, not shown. The side walls 20 and 22 of the mounting means 18 are outwardly extending and are adapted to cooperate with the undercut surface or groove 23 of the base member or portion 24 of an incandescent light assembly 26, in a conventional tongue and groove arrangement.

The upper surface or face plate 28 of the mounting plate 19 is provided with indicia 30 extending in a vertical column and calibrated in degrees which extend transversely. Each transverse line or indicia is calibrated in degrees which indicates the amount of degrees of anticipation or setback that the thermostat will be reading. For example, with the thermostat set at the 60 degree setting, the incandescent light assembly 26 set upon line or indicia of 30 degrees will cause the thermostat to effectively read a temperature which is 30 degrees higher than the ambient appearing in the rest of the room. The operation of the system will be described in detail hereinafter.

The base member 24, which is adjustable on mounting plate 19, of the incandescent light assembly 26 is provided with a bracket 34 adapted to hold the incandescent lamp 36 to the base member 24 by means of a pair of screws 38. The base member 24 is adapted to slidably engage the sloped sides 20 and 22 of mounting plate 19 and may be locked in position by locking means 40, which may be in the form of a wing screw 41 having a front end for engagement with upper surface 28 of mounting plate 19. The uppermost edge 42 of base member 24 is set to the particular line or indicia for the amount of degrees that the thermostat is desired to be set back. Thus, the thermostat will turn off the heating system prior to the setting thereon.

The light assembly further includes director means in the form of an element 44, which preferably is conically shaped and includes convection means in the form of apertures 46 at the lower portion thereof (FIG. 2). The apertures 46 extend through the wall of the element 44 and may be of a size, number and shape to obtain the desired end results. The element 44 may be fabricated from a transparent or translucent plastic material. The apertures 46 permit air to enter around the base portion of incandescent lamp 36 and permit convection air current to flow out of the uppermost opening 45 of director 44 when the incandescent lamp 36 is energized. The incandescent lamp 36 preferably is of miniature type having a wattage rating in the order of 25 watts.

The incandescent lamp 36 is energized by means of alternating current (AC) transmitted over a wire 48 coupled to the timer device 50. As shown in FIG. 1, the wire 48 is continuous, from the lamp to the timer device 50. However, this wire may include a plug 52 and receptacle 74 (FIG. 3) which may be received by the timer device 50 in a receptacle provided therefor, (not shown). An additional receptacle 54 may be provided on the timer device 50 so that the plug 52 may be inserted therein permitting continuous energization of the incandescent lamp 36.

The timer device 50 is provided with a clock and indicator dial 56 which is set or adjusted by means of knob 58 for the time of energization of incandescent lamp 36 and the turn off thereof. An on-off switch 60 is also included in the timer device 50 which is utilized for turning the system on and off. The source of energy may be a conventional wall receptacle, not shown, into which plug 80 is inserted, thereby carrying the alternating current, via a wire 64, to the timer device 50. Preferably, the voltage used to energize incandescent lamp 36 is reduced or lowered to a value between 6 and 24 volts so that it presents little danger to persons coming into accidental contact therewith.

Figure 3:
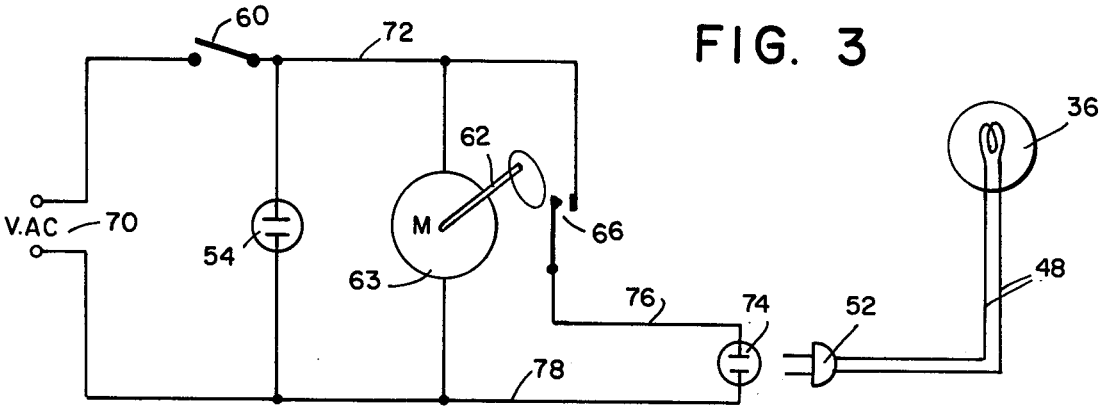
FIG. 3 is a schematic circuit diagram of the apparatus shown in FIG. 1.

Referring now, in particular, to FIG. 3, which is a schematic circuit diagram of the combination temperature anticipator and night light apparatus according to the principles of the present invention, there is shown a timing motor 63 having an output shaft 62 with an elongated cam 65 thereon. The elongated cam 65 is adapted to close the normally open switch contacts 66 on contact therewith.

The motor is coupled, via a wire 68, to a source of alternating voltage (current) 70. The alternating current preferably is between 6 and 24 volts, as mentioned earlier, and may be lowered to this value by means of a transformer, not shown, or any other suitable means. The other side of the timer motor 63 is coupled to the source of alternating current 70, via a wire 72, and on-off switch 60. An auxiliary receptacle 54 is connected between wire 72 and wire 68, thus providing a means of supplying the AC voltage continuously. The AC voltage, however, will still be controlled by the on-off switch 60. When the cam 65 closes the contacts of switch 66, it allows the alternating voltage to appear across receptacle 74. As mentioned earlier, the wires 76 and 78, which couple the AC to receptacle 74, may be continued to the base of incandescent lamp 36 without using the receptacle 74 and plug 52 arrangement as shown in FIG. 3.

In operation, the user of the apparatus disclosed herein will adjust the timer device 50 to determine at what time the incandescent lamp 36 is to be energized and also the time at which the lamp is to be de-energized or turned off. This is accomplished by turning knob 58 to set the indicator dials of clock 56. Plug 80 is placed in a conventional receptacle, and the power on-off switch 60 is turned to the on position. This will automatically provide energy to the incandescent lamp during the prescribed hours. Energizing the incandescent lamp will illuminate the room in which it has been installed and also provide heat, which by convection air currents will rise and heat the air surrounding thermostat 14.

As explained earlier, the air entering the apertures 46 will leave the director 44, via opening 45, and flow past the thermostat 14, thus making the thermostat read a temperature higher than that of the ambient temperature in the surrounding room. Adjusting the proximity of the light assembly 26 to the thermostat 14 will change the number of degrees of anticipation. Preferably, the mounting means 18 is mounted within one inch of the thermostat 14, thus permitting a maximum temperature anticipation or setback, which will approximate 30 degrees with an incandescent lamp wattage rating of about 25 watts. As the light assembly 26 is moved further away from the thermostat, the normal convection currents associated with the room will cause a dilution of the heat conducted to the thermostat, and thus lower the amount of anticipation or setback that the thermostat will be reading.

It is appreciated that the timer device 50, although shown as a separate component, may be incorporated or formed as part of the mounting means 18. For example, the timer device 50 may be formed as part of the base member 24 so that it is moved relative to the mounting plate 19.

Hereinbefore has been disclosed a combination temperature anticipator and night light apparatus for use with thermostatically controlled heating systems which is inexpensive to manufacture, simple to install, and is capable of reducing energy consumption without introducing any major inconvenience. The apparatus allows for adjusting the amount of anticipation or setback by merely moving the light assembly closer or further from the thermostat utilized with a conventional heating system.

Figure 4:
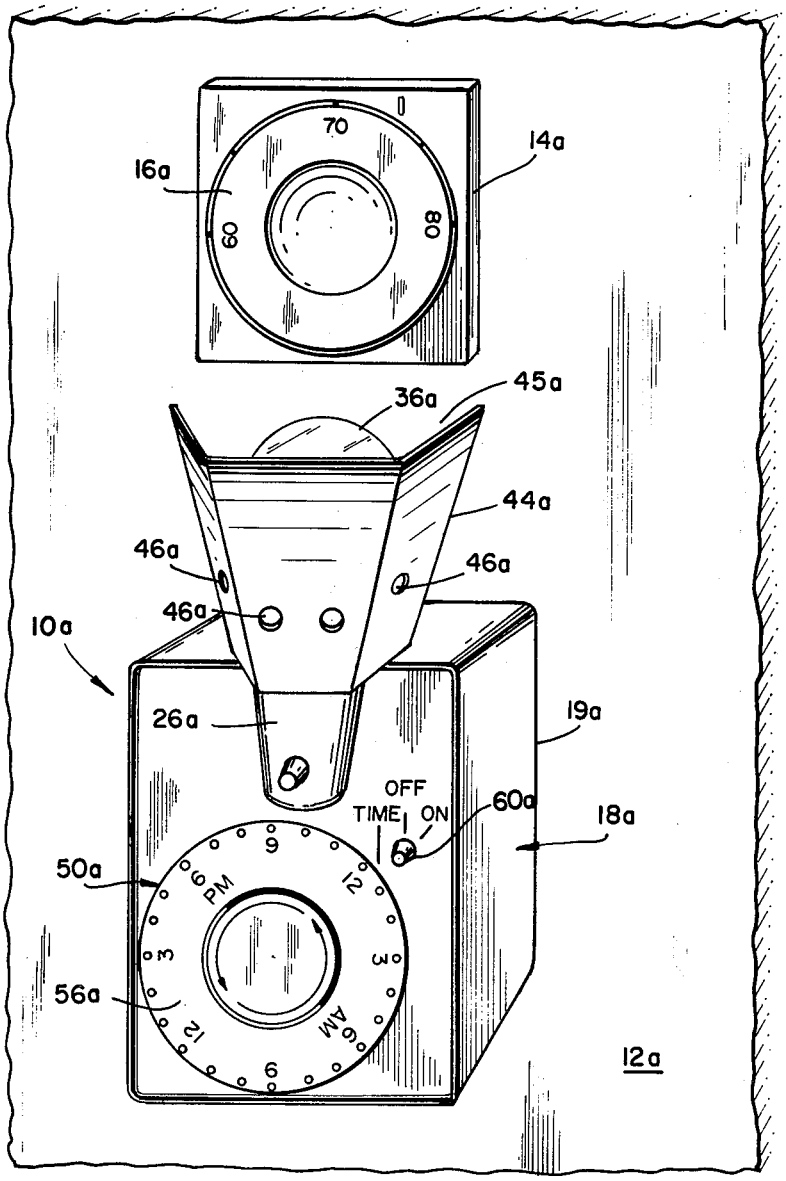
FIG. 4 is a perspective view of another embodiment in accordance with the present invention.

Referring now to FIG. 4 of the drawings there is shown a combination temperature anticipator and night light apparatus 10a mounted on a wall 12a proximate to a conventional thermostat 14a. The thermostat 14a includes a temperature control dial 16a and is connected to a heating system, not shown, which is conventional.

The apparatus 10a includes a mounting means 18a disposed vertically or in an upwardly direction proximate the thermostat 14a and is positioned in line and below it. The mounting means 18a includes a mounting plate 19a that may be affixed to the wall by using double-sided adhesive tape, screws, or any other conventional means, not shown. An incandescent light assembly 26a is mounted on the top of the mounting means 18a and includes an incandescent lamp 36a.

The light assembly 26a further includes director means in the form of an element 44a, which preferably is tapered in shape and may include convection means in the form of apertures 46a at the lower portion thereof. The apertures 46a extend through the wall of the element 44a and may be of a size, number, and shape to obtain the desired end results. The element 44a may be fabricated from a transparent or translucent plastic material. The apertures 46a permit air to enter around the base portion of incandescent lamp 36a and permit convection air current to flow out of the uppermost opening or top 45a of director 44a when the incandescent lamp 36a is energized. The incandescent lamp 36a preferably is of miniature type having a wattage rating in the order of 25 watts.

The incandescent lamp 36a is energized by means of alternating current (AC) transmitted from the timer device 50a. The timer device 50a is provided with a clock and indicator dial 56a which is set or adjusted by means well known for the time of energization of incandescent lamp 36a and the turn off thereof. An on-off switch 60a is also connected to the timer device 50a which is utilized for turning the system on and off. The source of energy may be a conventional wall receptacle, not shown, into which the mounting means 18a is connected, thereby carrying the alternating current, to the timer device 50a. Preferably, the voltage used to energize incandescent lamp 36a is reduced or lowered to a value between 6 and 24 volts so that it presents little danger to persons coming into accidental contact therewith.

In operation, the user of the apparatus disclosed herein will adjust the timer device 50a to determine at what time the incandescent lamp 36a is to be energized and also the time at which the lamp is to be de-energized or turned off. This is accomplished by turning indicator dial 56a of timer device 50a and the power on-off switch 60a is turned to the on position. This will automatically provide energy to the incandescent lamp 36a during the prescribed hours. Energizing the incandescent lamp 36a will illuminate the room in which it has been installed and also provide heat, which by convection air currents will rise and heat the air surrounding thermostat 14a.

While the form of temperature anticipator and night light apparatus described herein constitutes a preferred embodiment of the invention, it is to be understood that the invention is not limited to this precise form of device, and changes may be made therein without departing from the scope and spirit of the invention as defined in the appending claims.

I claim:

1. A combination temperature anticipator and night light apparatus for use with thermostatically controlled heating systems comprising:

A. mounting means disposed vertically proximate said thermostat and therebeneath, B. incandescent light means affixed to said mounting means for providing a source of heat and light when energized, C. director means circumscribing said light means for directing the heat from said light means towards said thermostat, D. timer means coupled to a source of electrical energy for transmitting said electrical energy to said light means at prescribed intervals, E. said timer means being programmed to energize said light means only during the hours of darkness and including a clock with an indicator dial and a knob for adjustment for the time of energization of said light means, F. said mounting means includes an elongated mounting plate adapted to be secured to a wall and having indicia thereon and a base member having an uppermost edge, said uppermost edge being adjustable relative to said indicia to preselected temperature levels and having said light means affixed thereto, G. said indicia is calibrated in degrees for indicating the number of anticipatory degrees provided when said light means is energized and positioned thereon, said indicia is formed in a vertical column and calibrated in temperature degrees which extend transversely to said column, H. locking means for adjustably securing said light means to any selected indicia on said mounting means, and I. convection means operatively associated with said director means so as to obtain air currents such that the heat from said light means is directed towards said thermostat and said director means includes an element having an open end from which the heat from said light means is directed towards said thermostat and said element is conically shaped and said convection means comprises a plurality of apertures extending through the wall thereof.

2. An apparatus according to claim 1, wherein said director means is transparent.

3. An apparatus according to claim 1, wherein said director means is translucent.

4. An apparatus according to claim 1, wherein said apertures are formed in the lower portion of said element.

5. An apparatus according to claim 1, wherein said base member is adjustable relative to said mounting plate by means of a tongue and groove arrangement.

6. An apparatus according to claim 5, wherein said locking means includes a wing-screw threadably connected to said base member and having a front end for engagement with said mounting plate.

7. An apparatus according to claim 1, wherein said mounting plate includes a face plate having said indicia thereon.

8. An apparatus according to claim 7, wherein said base member extends longitudinally along said mounting plate in substantial alignment with said vertical column of said indicia.

9. An apparatus according to claim 8, wherein said uppermost edge of said base member is the surface brought into alignment with the temperature degrees of said indicia.

10. An apparatus according to claim 1, wherein said timer means includes a switch and a cam for actuation of said switch for controlled periods of time.

* * * * *